United States Patent [19]

Hosbein

[11] 4,222,535

[45] Sep. 16, 1980

[54] WIRE DEREELING APPARATUS

[75] Inventor: Hugh W. Hosbein, Fort Wayne, Ind.

[73] Assignee: Mossberg Hubbard, Division of Wanskuck Company, Garrett, Ind.

[21] Appl. No.: 58,015

[22] Filed: Jul. 16, 1979

Related U.S. Application Data

[63] Continuation-in-part of Ser. No. 38,087, May 11, 1979, abandoned.

[51] Int. Cl.[3] ..... B65H 49/00

[52] U.S. Cl. ..... 242/128

[58] Field of Search ..... 242/47.01, 47.1, 47.11, 242/128, 147 R; 66/132 R, 125; 139/122 R; 57/58.83, 58.86

[56] References Cited

U.S. PATENT DOCUMENTS

| | | | |
|---|---|---|---|
| 2,366,101 | 12/1944 | Grothey | 66/125 |
| 2,425,525 | 8/1947 | Franz | 242/128 |
| 2,838,922 | 6/1958 | Gift | 66/125 |

*Primary Examiner*—Leonard D. Christian

*Attorney, Agent, or Firm*—Gust, Irish, Jeffers & Hoffman

[57] ABSTRACT

This invention relates to dereeling apparatus for unreeling wire from a spool preferably disposed with the axis thereof upright. A first cylindrical shroud is adapted to be positioned coaxially over the spool in radially spaced relation therewith and with the upper end of the shroud disposed above the spool. A ring of multiple circumferentially spaced axially extending bristles of resilient material is provided on the upper end of the shroud. A second cylindrical shroud of larger diameter than the first and coaxially disposed to overlie the ring in radially spaced position is mounted on the upper end of the first shroud. The second shroud is provided with a cover having a centrally located aperture which receives a strand of wire being unreeled from the spool.

11 Claims, 9 Drawing Figures

WIRE DEREELING APPARATUS

This is a continuation-in-part of application Ser. No. 038,087, filed May 11, 1979 now abandoned.

BACKGROUND OF THE INVENTION

1. Field of the Invention

The present invention relates to apparatus for unreeling wire from a wire-carrying spool and more particularly to dereeling apparatus which carries a ring of resiliently flexible bristles for catching and holding an unreeled coil of wire following cessation of unreeling wire from the spool.

2. Description of the Prior Art

Dereeling apparatuses conventionally employ funnel shaped shrouds disposed in an inverted position over a pail or the like in which is mounted a spool having hellically wound wire thereon. Wire is drawn axially off the spool through the funnel at relatively high speed, such high speed causing the wire to flare outwardly into coils of larger size than the upper flange on the spool, these larger coils impinging the funnel and thereby being directed toward the central opening thereof.

In dereeling wire from the spool, it is often times necessary, at frequent intervals, to suddenly stop the dereeling. Upon such sudden stoppage, the loose coils that have flared outwardly and which are larger than the spool flange fall to a position of rest, frequently such coils falling one on top of the other. As a consequence, since the coils are loose, they tend to fall one over the other and to become entangled. Upon restarting the dereeling operation, the tangled coils do not cleanly separate thereby becoming knotted in such a manner that they cannot be drawn through the orifices of the dereeler.

SUMMARY OF THE INVENTION

The present invention is directed to the provision of an apparatus which avoids the problems of tangling as just described. When used with a spool of wire, the spool preferably is disposed with the axis thereof upright. A first cylindrical shroud is positioned coaxially over the spool in radially spaced relation therewith and with the upper end thereof disposed above the spool. A ring of resiliently flexible bristles is mounted on the upper end of this shroud. A second cylindrical shroud of larger diameter is coaxially disposed to overlie the ring of bristles in radially spaced relation. An aperture in the second shroud is disposed centrally of the second shroud for receiving a strand of wire being unreeled from the spool. As wire is rapidly payed off the spool over the top flange, it quickly attains a velocity which causes the unwound coils to flare outwardly. By reason of the proximity of the encircling shrouds, the enlarged coils come into contact therewith, certain of these coils engaging the second shroud disposed radially outwardly from the ring of bristles. If the dereeling operation is stopped, the coils in contact with the second shroud fall under the force of gravity. Since the coils originate from the inside of the first shroud and the ring of bristles, the larger coils engaged with the second shroud fall onto the bristles and become entrained therein. The bristles thus hold the loose coil or coils from falling any further and becoming entangled. Upon restarting the dereeling operation, the coils retained by the bristles are merely pulled therefrom thereby providing a clean start without any entanglement.

It is an object of this invention to provide dereeling apparatus which overcomes the problem of tangling during stoppage of an unreeling operation.

It is another object of this invention to provide in dereeling apparatus a system of bristles for catching a loose coil of wire resulting from cessation of a dereeling operation for the purpose of holding such loose coils in separated relationship until a dereeling operation is started again.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
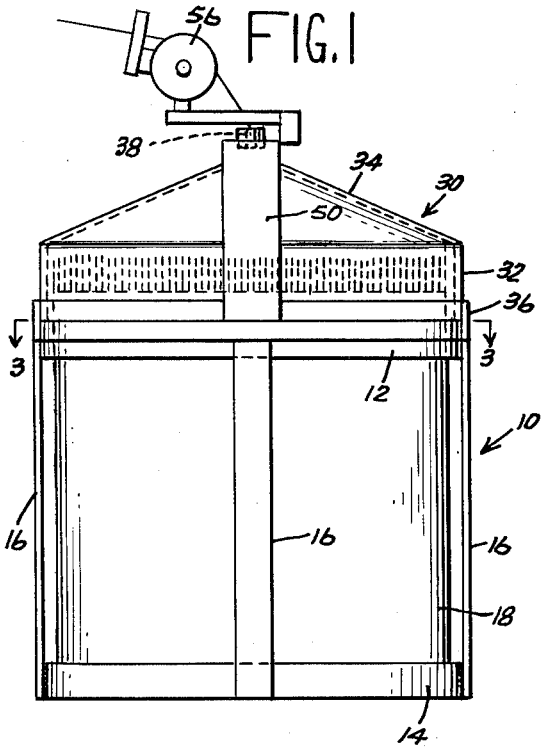
FIG. 1 is a side view of one embodiment of this invention.
Figure 3:
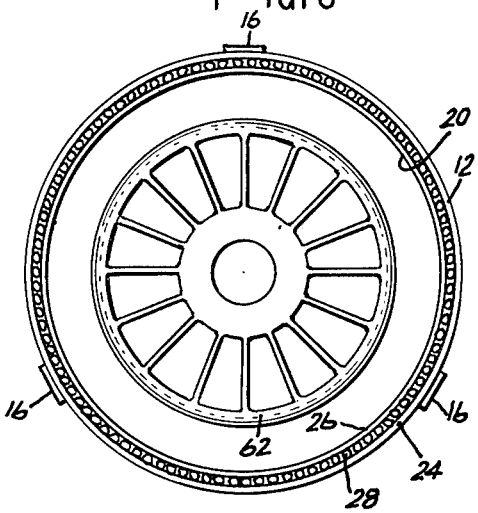
FIG. 3 is a top plan view of the bottom shroud portion of the dereeling apparatus of the preceding figures taken substantially along section line 3—3 of FIG. 1.
Figure 4:
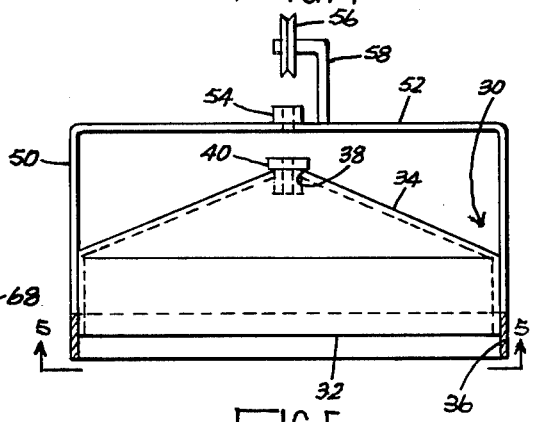
FIG. 4 is a side view of the upper shroud portion of the dereeling apparatus.

Referring to the drawings, the apparatus includes an essentially cylindrically shaped frame generally indicated by the numeral 10 having upper and lower coaxially mounted rings 12 and 14 of steel or the like. These rings 12 and 14 are secured in position by three or more upright, rigid steel bars 16 by welding, the ring 12 having a portion extending above the upper ends of the bars 16.

Figure 8:
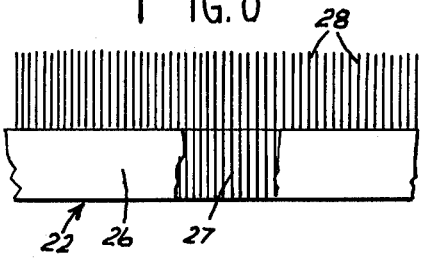
FIG. 8 is a fragmentary side view of the bristle ring of FIGS. 1–3 and 6.
Figure 9:
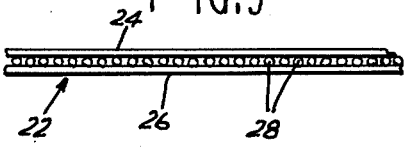
FIG. 9 is an edge view thereof.

Affixed by some suitable means, such as adhesive, to the interior of the frame and more particularly the rings 12 and 14 is a cylindrical shroud 18 of a suitable, nonabrasive material such as plastic. This shroud 18 has a portion 20 which extends above the ring 12 as shown. To the portion 20, and more particularly to the outer surface thereof, is secured a ring of projections or bristles indicated generally by the reference numeral 22. As shown more clearly in FIGS. 8 and 9, this ring 22 in one form is composed of two strips 24 and 26 of adhesive tape having sandwiched and adhered therebetween transversely extending bristles or monofilaments 28. More specifically, the strips 24 and 26 are of duct tape having the pressure sensitive adhesive sides adhered together. The bristles 28 preferably are nylon monofilaments spaced apart in parallelism a distance approximately equal to the diameter of one filament. This spacing may vary, however, as will appear obvious from the description that follows. Dimensionally, for a working embodiment of the invention, the strips 24 and 26 may be about two inches wide and the monofilaments about four inches long, but as will also appear from the description as follows, these dimensions may vary without departing from the spirit and scope of the invention.

Figure 6:
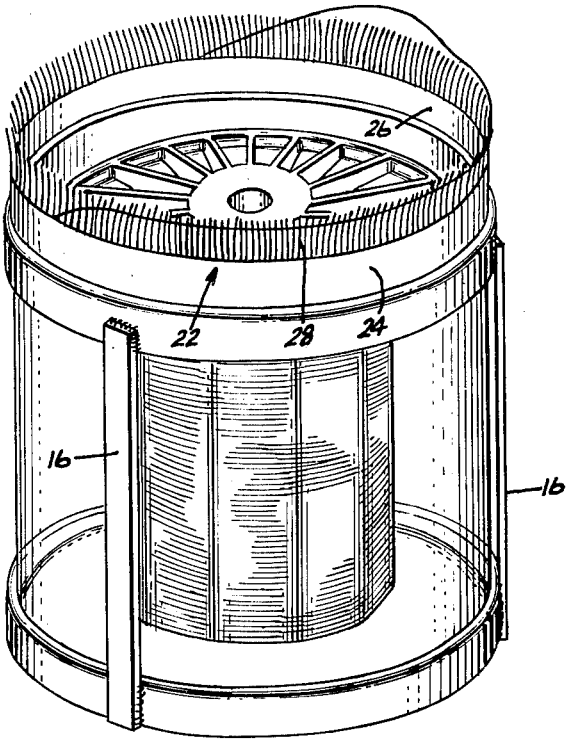
FIG. 6 is a perspective illustration of the bottom shroud portion and showing a coil of wire nested in the ring of bristles during a period when the wire is not being drawn from the spool.
Figure 2:
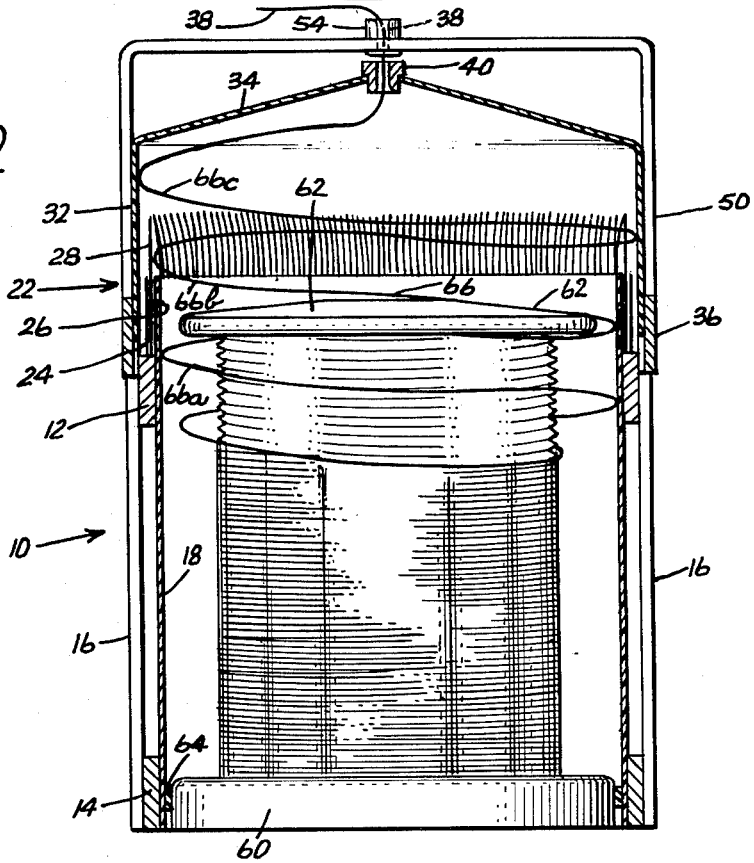
FIG. 2 is a longitudinal sectional view thereof.

The bristle ring 22 is snugly telescoped or adhered over the extension 20 on the shroud 18, with the bristles 28 extending axially therebeyond as shown more clearly in FIG. 2. As shown in FIG. 6, in a working embodiment, the bristles 28 need not necessarily extend axially straight but may project somewhat randomly, radially inwardly and outwardly as well as circumferentially. Of importance is the fact that the bristles or monofilaments 28 are flexible and resilient and to this end may be of nylon varying in diameter from 0.008 to 0.062 inch. A diameter of about 0.022 inch was found to be particularly useful.

The shroud 18 may in one sense be considered a container having open opposite ends. A cap generally indicated by the numeral 30 (FIGS. 1, 2, 4 and 5) is composed of essentially two parts, a tubular shroud portion 32 and a frusto-conically shaped cover 34. A steel ring 36 is adhered to the peripheral surface of the shroud portion 32 in such position that a portion thereof extends below shroud portion 32 as shown.

Dimensionally, the ring 36 is made slightly larger in diameter such that it will telescope over the ring 12 to rest on the upper ends of the bars 16. So positioned, the shroud portion 32 is spaced radially outwardly from the inner shroud portion 20 and the bristles 28 as shown more clearly in FIG. 2.

The cover 34 is provided with a central aperture 38 having fitted thereinto a strand-receiving bushing 40. Rigidly secured to the cover 30 is a handle-like frame having the opposite ends welded to the ring 36. The cross portion 52 thereof extends diametrically across the cap 30 and is provided with a bushing 54 also for receiving the wire strand. Immediately above the bushing 54 is a conventional idler wheel 56 journaled on a support 58 secured to the cross portion 52. The strand that is received by the bushing 54 is threaded over the wheel 56 for receiving and guiding a wire strand from the apparatus.

As shown more clearly in FIGS. 2 and 6, the apparatus thus far described may be used in unreeling a strand of wire from a conventional barrel type spool having end flanges 60 and 62. With the spool set in an upright position on a flat surface and the shroud 18 telescoped thereover with an annular strip 64 of pliable material being interposed between the shroud 18 and flange 60 as shown, wire which is helically wound on the spool is threaded upwardly past the flange 62 through the space between the perimeter of this flange 62 and the shroud 18. Above the flange 62, the strand now indicated by the numeral 66 is threaded upwardly through the bushings 50 and 54 and over the idler wheel 56. During dereeling, the strand is drawn through the bushings 40 and 54. This results in the withdrawal of strand 66 from the spool. When the rate of withdrawal reaches a given value, the strand being drawn off the spool is thrown outwardly under sufficient centrifugal force that the coils thereof, as indicated by the numeral **66*a* impinge the shroud 18. A number of such coils 66*a* as further indicated by the numerals 66*b* and 66*c* are developed, each of these engaging the respective shrouds 18 and 32. During withdrawal, the coils 66*a*, 66*b* and 66*c* (there may be more or less coils depending upon the size of the strand and the rate of withdrawal) progress upwardly along the shroud 18, shroud portion 20 and finally onto the bristles 28 from which further upper progression results in the coil 66*c* being thrown even farther outwardly against the shroud portion 32. The shrouds thus contain the coils from being uncontrollably thrown outwardly thereby permitting uniform withdrawal of the wire through the bushings 40 and 54**.

Should the withdrawal of wire from the apparatus suddenly cease, it will be noted that there is nothing to prevent the coils, especially coils **66*c*, from falling. The coil 66*c* in fact does fall and since there is a portion of the coil on the inside of the shroud portion 20, it will at once become apparent that the coil 66*c* will drop onto the bristles 28. The bristles 28 present upwardly exposes spaces between bristles into which the coil 66*c* may fall. This results in the coil 66*c* being retained in the ring of bristles 28 as more clearly indicated in FIG. 6 by the coil 66*d*. The lower most coils such as 66*a* and 66*b* thus tend to be supported by the upper coil 66*d***.

When strand withdrawal is resumed, the coil **66*d*** merely lifts out of the bristle ring and the dereeling operation continues as before.

The reason for the bristle ring 22 may now be explained. Without some such catching device as the bristle ring, when withdrawal of strand has been suddenly stopped, it is not uncommon for the enlarged, gravitating coils to fall over each other and to become entangled. When withdrawal is resumed, this entanglement does not always release resulting in the coils becoming knotted and bunched. In this condition, the strand cannot be drawn through the bushings 40 and 54. This requires shut-down of the apparatus, cutting out the entangled portion and rethreading before the dereeling operation can be resumed. By reason of the presence of the bristle ring 22, the enlarged uppermost coil or coils is captured thereby holding them in position, without entanglement, until the dereeling operation is resumed. Shut-down time for removing the entanglements thus is avoided.

Figure 7:
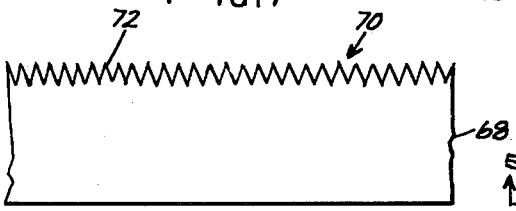
FIG. 7 is a view of a sheet of material which can be formed into a cylindrical shape and provided with bristles or projections along one edge that provide the bristle ring shown in the preceding figures.
Figure 5:
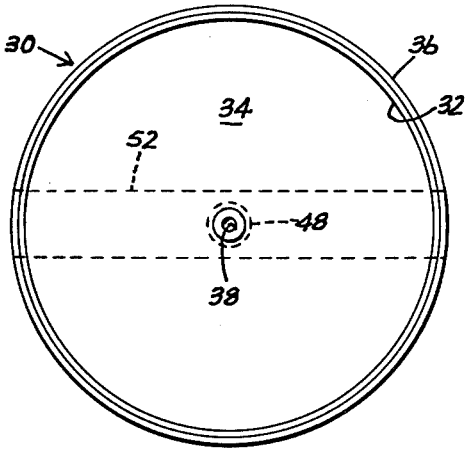
FIG. 5 is a bottom view of the second shroud taken substantially along section line 5—5 of FIG. 4.

While the bristles 28 have been described as being in the form of nylon monofilaments, they may be formed as shown in FIG. 7 at the same time sheet material for the shroud 18 is being cut. The numeral 68 indicates a rectangular sheet of plastic cut from a piece of flat stock. The upper edge 70 is serrated into filament type projections or bristles indicated by the numeral 72. The flat sheet of material 68 is formed into the shape of the cylindrical shroud 18 with the serrated edge 70 uppermost. The material of the plastic and size of the bristles 72 are so selected as to provide for the degree of flexibility and resilience needed to permit outward flexure of the bristles during upward progression of the coils **66*a*, 66*b* and 66*c* as well as to catch the gravitating uppermost coil 66*c*** when the system is suddenly stopped. Typical dimensions for a working embodiment of this invention are given in the following, these being exemplary only and are not to be considered as limitative of the invention.

Inner diameter of shroud 18—16.250 inches
Radial thickness of ring 12—$\frac{3}{8}$ inch
Outer diameter of ring 12—16.450 inches
Inner diameter of ring 36—17.515 inches
Radial space between shroud portion 32 and bristle ring 22—0.43125 inch
Length of bristles 28 extending above shroud portion 20—0.750 inch
Typical size of wire being payed off spool—18 ga. to 30 ga.

Inner Diameter of shroud portion 32—17.3125 inches

While the bristle ring 22 is shown as being disposed above the flange 62, it can be raised or lowered from the position shown and still function as described to retain a loose coil during cessation of dereeling operation. Also, the size of the shroud portion 32 may be varied, the size thereof being determined by that necessary to insure that a loose coil 66c will drop onto and nest within the bristle ring 22. Spacing between bristles also may be selected to be slightly larger than the wire being unreeled to assure capture of the coil 66c.

While there have been described above the principles of this invention in connection with specific apparatus, it is to be clearly understood that this description is made only by way of example and not as a limitation to the scope of the invention.

What is claimed is:

1. Dereeling apparatus for unreeling wire from a spool disposed with the axis thereof upright comprising a first cylindrical shroud adapted to be positioned coaxially over said spool in radially spaced relation therewith and with the upper end disposed above said spool, a ring of multiple circumferentially spaced projections on the upper end portion of said first shroud, a second cylindrical shroud of larger diameter than the first and coaxially disposed to overlie said ring in radially spaced relation, and means disposed centrally of said shrouds axially above said ring for receiving a strand of wire being unreeled from said spool.

2. The apparatus of claim 1 wherein said projections are resiliently flexible and extend axially.

3. The apparatus of claim 2 wherein said projections are in the form of bristles of plastic.

4. The apparatus of claim 2 wherein said projections are in bristle like form, said second shroud being in the form of a cap which is removably mounted on the upper end portion of said first shroud, said means including an aperture in said cap centrally thereof.

5. The apparatus of claim 4 wherein said bristles are of plastic with some having the distal ends randomly radially displaced, the spacing between bristles corresponding to the size of wire being unreeled.

6. The apparatus of claim 5 wherein the spacing between said ring and said second shroud provides an annular clearance for receiving a coil of wire, a bottom for said annular clearance being provided on one of said shrouds, and said bottom being disposed beneath said ring in close proximity thereto.

7. The apparatus of claim 6 wherein said first shroud is in the form of a container for receiving said spool, a frame receiving said container, said frame including an annular member encircling said first shroud in closely spaced relation adjacent to the upper end thereof, an upright support secured to the outside of said annular member for holding the latter in position, said cap having a supporting ring on the exterior of said second shroud which projects axially therebeneath, said supporting ring being partially telescopable over said annular member and engageable for vertical support with the upper end of said upright support, the upper edge of said annular member thereby serving as said bottom for said clearance, and said cap having a frusto-conically shaped upper end with said aperture therein.

8. The apparatus of claim 7 wherein said ring of bristles includes a plurality of self-supporting plastic monofilaments secured at one end portion to the exterior of said second shroud above said annular member by means of a band of adhesive tape.

9. The apparatus of claim 3 wherein said bristles are of a length of from about two to four inches and of a diameter of from about 0.008 to 0.062 inch, the spacing between bristles being about equal to the diameter thereof.

10. The apparatus of claim 3 wherein said shrouds are of plastic.

11. For use in a dereeling apparatus, a coil-retaining device including a stepped diameter cylindrical dereeling shroud, said shroud having a first tubular portion adapted to receive a spool of wire with the spool coaxially disposed therewithin and a second tubular portion of larger diameter than and coaxially disposed at one end of said first portion; a bristle ring on said one end as a tubular extension of said first portion, the bristles of said ring extending parallel to but being radially spaced from said second portion.

* * * * *